United States Patent [19]

Baccelliere

[11] Patent Number: 4,979,343

[45] Date of Patent: Dec. 25, 1990

[54] CHIMNEY

[76] Inventor: Luciano Baccelliere, Via Valverde n. 27, 16014 Genoa, Italy

[21] Appl. No.: 710,701

[22] Filed: Mar. 11, 1985

[30] Foreign Application Priority Data

Mar. 29, 1984 [IT] Italy ..... 12473 A/84

[51] Int. Cl.[5] ..... E04F 17/02; E04H 12/28

[52] U.S. Cl. ..... 52/218; 52/219

[58] Field of Search ..... 52/218, 219

[56] References Cited

U.S. PATENT DOCUMENTS

| | | | |
|---|---|---|---|
| 512,707 | 1/1894 | Jarvis | 52/219 |
| 610,396 | 9/1898 | Ganzel, Sr. | 52/218 |
| 761,953 | 6/1904 | Friedlander | 52/218 |
| 865,372 | 9/1907 | Flynn | 52/218 |
| 2,037,007 | 4/1936 | Conahey, Jr. | 52/219 |
| 2,175,564 | 10/1939 | Ingham | 52/218 |
| 2,275,902 | 3/1942 | Hasenburger et al. | 52/219 |
| 2,277,436 | 3/1942 | Howle | 52/219 |
| 2,304,500 | 12/1942 | Hoesli | 52/218 |
| 2,342,058 | 2/1944 | Morris | 52/219 |
| 2,372,707 | 4/1945 | Blome | 52/218 |
| 2,392,631 | 1/1946 | Berndt | 52/218 |
| 2,455,570 | 12/1948 | Droeger | 52/218 |
| 2,713,301 | 7/1955 | McKann | 52/218 |
| 3,160,087 | 12/1964 | Davidson | 52/219 |
| 4,173,923 | 11/1979 | Snook | 52/218 |

FOREIGN PATENT DOCUMENTS

| | | | |
|---|---|---|---|
| 816499 | 7/1969 | Canada | 52/219 |
| 908784 | 3/1954 | Fed. Rep. of Germany . | |
| 2800624 | 6/1982 | Fed. Rep. of Germany . | |
| 3317661 | 11/1984 | Fed. Rep. of Germany | 52/218 |
| 587218 | 1/1959 | Italy | 52/218 |
| 670700 | 6/1979 | U.S.S.R. | 52/218 |
| 353606 | 7/1931 | United Kingdom . | |
| 828106 | 2/1960 | United Kingdom . | |

*Primary Examiner*—Michael Safavi

*Attorney, Agent, or Firm*—Jacobs & Jacobs

[57] ABSTRACT

This patent covers a chimney in prefabricated modular elements, normally but not exclusively to be built outside buildings.

The flue stack consists of two modular prefabricated elements (A,B) to be assembled by progressive raising. The first element (A) is consisting of an outer covering pipe (1) usually having a square cross section, an intermediate pipe (2) usually having a circular cross section and an internal liner (4) usually having a circular cross section, all pipes being rectilinear and interconnected by stirrups, while the hollow space between outer (1) and intermediate pipe (2) is filled with insulating material (3). The second element (B) has normally a shorter length than the first and consists of an outer envelope (pipe) (1), an intermediate pipe (2), both rectilinear, while the internal pipe (4) has a bend or branch at its lower end for connection to the exhaust of the various users. The pipes of the two modular elements A and B have all the same cross sections so that they can be easily assembled and locked into place by suitable fastening devices (5, 10) and secured onto the wall by stirrups or brackets (12). This means that the waste gases produced on each floor of the building are conveyed over a considerable distance, usually corresponding to the height between floors, through the inner pipe (4) before entering the intermediate pipe (2) representing the main flue stack operating at strong draught, while the erection of the chimney is facilitated by the limited weight of the prefabricated modular elements of refined design.

5 Claims, 2 Drawing Sheets

CHIMNEY

This invention relates to a flue or chimney in prefabricated modular elements, normally but not exclusively to be built outside buildings.

Various flues or chimneys are nowadays known, including classical brickwork chimneys or preformed (prestressed, eternit, etc.) flues which are mostly incorporated in the walls. In the past, these chimneys were built as one continuous flue into which all user exhausts were led (boilers, water heaters, kitchen hoods, etc.) from the various floor levels. At present, the exhaust ducts do not directly lead into the chimney, but are conveyed along an autonomous vertical duct length to prevent backup or insufficient draught; this solution involves, however, larger dimensional requirements and additional installation costs.

Besides these drawbacks, the consideration must also be given to the current prefabrication trend, with prefabricated wall and partition panels of limited thickness not allowing for the incorporation of flues and chimneys. This makes the installation of chimneys outside the buildings much more advantageous since they no longer affect the building structures directly and won't require any repair jobs to remove the soot stains often caused by water infiltration seeping into the chimney or by pipe burst due to settling of the building.

The already existing external chimneys are virtually pipe-shaped and therefore do not meet efficient operation and draught requirements; they are also rather unsightly, expensive to build and of little efficiency.

This invention has the aim to provide for a chimney to be normally located outside the building and apt to ensure an efficient functioning, limited dimensional requirements and weight, refined design and limited cost.

This objective is achieved by a chimney consisting of prefabricated modular elements, substantially involving an external covering pipe, an intermediate pipe and an internal pipe, the latter and the intermediate pipe being separated by insulating material; the intermediate pipe forming the main flue duct, whereas the internal pipe covers a certain length, usually corresponding to the height between floors while its end section is connected to the users.

An embodiment of the invention in question is illustrated in its practical implementation mode, in the enclosed drawings in which.

Figures 1, 2, 3, 4, 5:
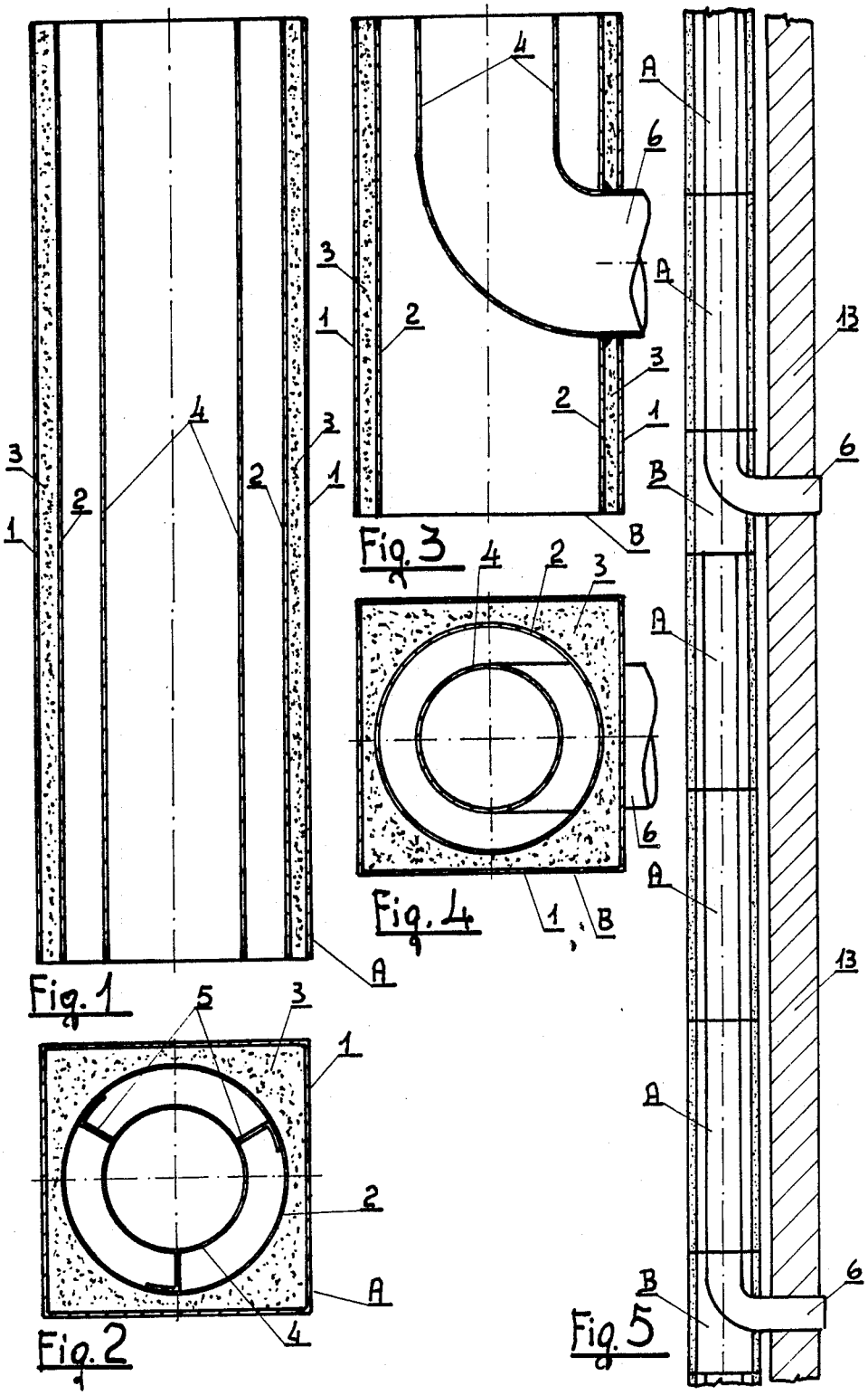
FIG. 1 shows in vertical central section a first prefabricated modular flue element according to the embodiment of the invention.
FIG. 2 shows in horizontal section the element illustrated in FIG. 1.
FIG. 3 shows in vertical central section the second prefabricated modular flue element according to the embodiment of the invention.
FIG. 4 shows in horizontal section the second element in FIG. 3.
FIG. 5 shows in vertical central section a length of the assembled chimney.

With reference to the above illustrations, the external envelope 1 of the first prefabricated modular element A normally consists of a pipe with square cross section. Inside this square shaped envelope are located a straight intermediate pipe 2 with its axis on the axis of the pipes 1. The hollow space between the envelope 1 and the intermediate pipe 2 is filled with insulating material 3, such as glass wool, vermiculite etc. The normally cylindrical shaped internal pipe 4 is straight and is placed concentrically inside the intermediate pipe 2.

The three pipes 1, 2 and 4 are secured to one another by stirrups or brackets 5 by means of screws, rivets or by welding.

The intermediate pipe 2 acts as a main flue duct whereas the internal pipe 4 acts as a flue duct for each single user.

The second prefabricated modular element B is normally shorter than the first element A and also consists of an outer envelope 1, an intermediate duct 2 and an internal pipe 4 which features a bend at its lower end 6 for connection to the exhaust of the users.

It is thus obvious that the assembly of various elements A and B, one on top of the other, in sufficient number and length will provide for a chimney operating as shown in FIG. 5, consisting of three elements A for each floor level, although they may be made up of any number.

Figure 6:
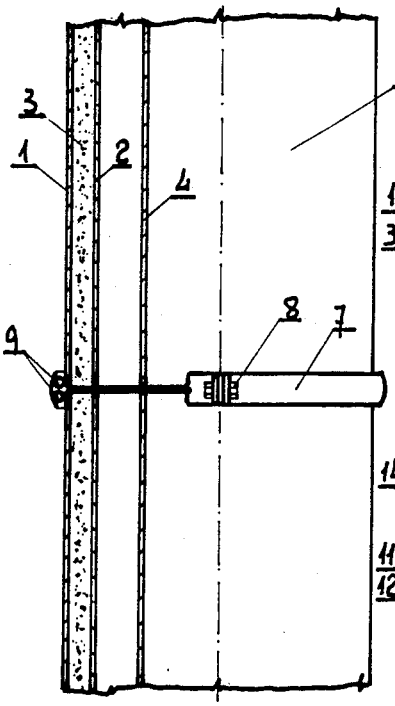
FIG. 6 shows an exemplified jointing of two prefabricated external flue elements.

FIG. 6 shows an exemplified connection between the envelope of two elements A and B, when element A is on top of element B. They are kept together by a clamping device 7 tightened by screws 8, surrounding the end sections of the envelope 1 with the interposition of packings or gaskets 9.

Figure 7:
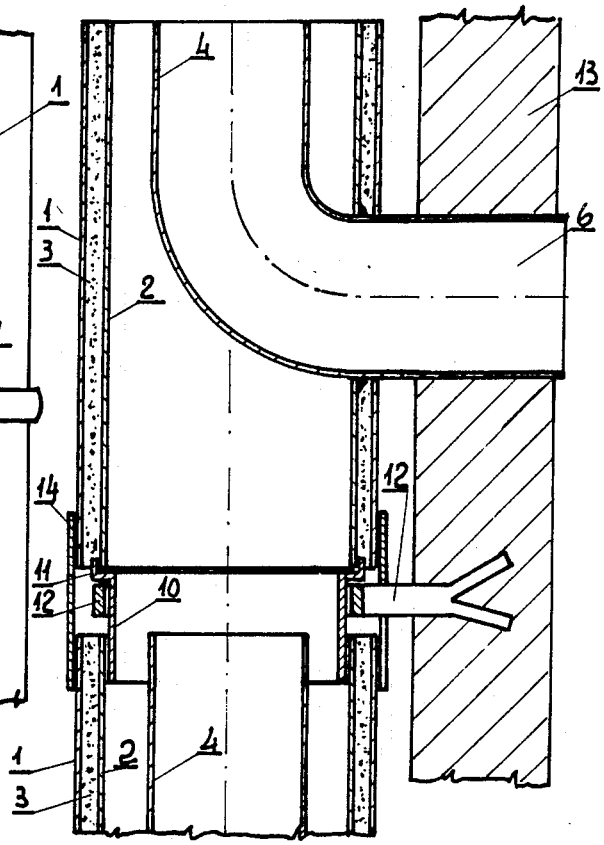
FIG. 7 shows an exemplified jointing of two intermediate prefabricated flue elements, fastened onto the wall.

FIG. 7 gives an example of the jointing between two superimposed internal pipe components A and B of the chimney B on top of A at wall mounting level. This is achieved by a tubular pipe fitting 10 penetrating into the lower pipe 2 and with an upper bellmouth 11 in which the upper pipe fits. This fitting will make up for any difference in length and will also allow securement of the pipe onto the wall 13 by means of stirrups 12. The above described jointing is externally protected by the clamping device 14.

Obviously, connection between the internal pipes 2 and 4 of the various A and B components can also be ensured by the jointing elements 10 and 11 which are similar, but other devices such as clamps and packings may also be used according to need.

Figure 8:
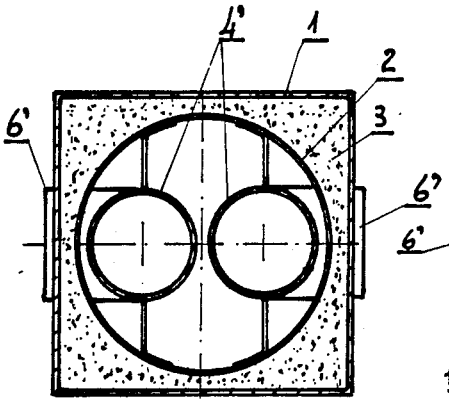
FIGS. 8 and 9 show examples of chimneys with a multiple internal pipe.
Figure 9:
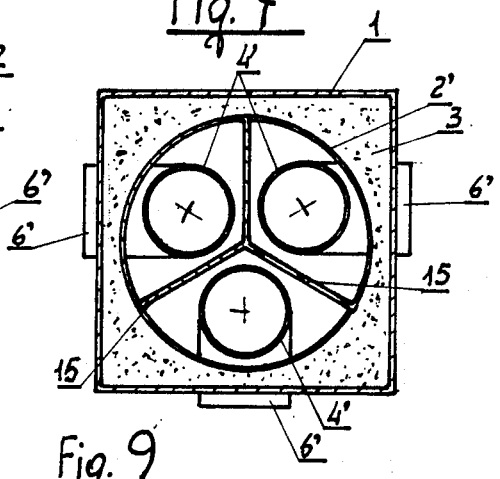

FIG. 8 shows a chimney of the described type, consisting of two or more internal pipes 4' with ends 6' extending in different directions which can be used to connect two or more users at the same time on the same floor level. If the main duct 2' is receiving at the same time waste gases of different nature (boiler flue gas, hood exhausts, aeration from sanitary facilities etc.), the main duct is partitioned into independent sectors 15 and the various internal pipes 4', complete with their connections 6' to the users, will be located in these sectors 15. (See FIG. 9).

No need to say that the above described flue can also be incorporated in walls or concrete castings, if deemed feasible or appropriate, but in such case, the external envelope 1 and possibly also the insulating material 3 will no longer be needed.

The external envelope 1, the intermediate pipe 2 and the inner duct 3 are usually in stainless steel to ensure a long and unaltered life, to prevent deposits and to eliminate any flue gas resistance, but these pipes may also be in other materials such as plastic, glass, asbestos cement, brickwork etc. Furthermore the chimney in question can be in prefabricated reinforced concrete to be built into the wall as an integrated hood bearing component.

The chimney at least of the preferred embodiment of this invention therefore provides for a simple and economic structure due to its prefabrication, the reduced weight of its various elements and perfect functionality, never giving rise to backup or poor draught, even when the percentage of users in operation is less than those that are switched off.

What is claimed is:

1. A chimney for a multi-floor building, which comprises first and second prefabricated modular elements, said prefabricated modular elements each comprising a first duct having a straight axis, a second duct within said first duct, and open-ended envelope means surrounding said first duct, said first and second ducts of said first modular element being straight and coaxial, said second duct of said second modular element having a straight portion with a straight axis coaxial with said first duct thereof and a branch portion branching away from said straight portion; said first modular elements being connected together one above the other with said ducts thereof in alignment to form a plurality of groups, and a second modular element is provided between adjacent groups of said first modular elements with said first ducts of said modular elements being connected together to form a main flue duct and with said second duct straight portions of said second modular elements being in communication with said second duct of said first modular element thereabove to form service ducts for connection to various users, whereby exhaust gases from each user are discharged into said main flue duct at separate locations downstream of said user.

2. A chimney according to claim 1, wherein said second modular elements are spaced apart by said groups by a distance corresponding to the distance between floors of said building.

3. A chimney according to claim 1, wherein said ducts are of stainless steel.

4. A chimney according to claim 1, wherein a tubular element is connected to the bottom of said first duct of said second modular element and extends downwardly into the first duct of said first modular element therebelow.

5. A chimney according to claim 1, wherein means are provided to secure the chimney to the exterior wall of the building.

* * * * *